US005241341A

United States Patent [19]

Okauchi et al.

[11] Patent Number: 5,241,341

[45] Date of Patent: Aug. 31, 1993

[54] IMAGE FORMING APPARATUS HAVING A THERMAL PRINTING DEVICE

[75] Inventors: Yoshifumi Okauchi; Yukihiro Ito, both of Osaka, Japan

[73] Assignee: Mita Industrial Co., Ltd., Osaka, Japan

[21] Appl. No.: 757,291

[22] Filed: Sep. 10, 1991

[30] Foreign Application Priority Data

Sep. 18, 1990 [JP] Japan ..... 2-250667
Sep. 18, 1990 [JP] Japan ..... 2-250668
Sep. 18, 1990 [JP] Japan ..... 2-250669

[51] Int. Cl.[5] ..... G03G 15/00
[52] U.S. Cl. ..... 355/202; 346/76 PH
[58] Field of Search ..... 355/202, 321, 324, 200, 355/210, 211, 282, 285, 215; 346/76 PH; 219/216

[56] References Cited

U.S. PATENT DOCUMENTS

| | | | |
|---|---|---|---|
| 4,342,040 | 7/1982 | Fujita et al. | 346/76 PH |
| 4,630,921 | 12/1986 | Watanabe | 355/202 |
| 4,744,680 | 5/1988 | Hirosaki et al. | 346/76 PH X |
| 4,819,021 | 4/1989 | Doery | 355/324 |
| 4,891,678 | 1/1990 | Ishizu et al. | 355/285 |
| 4,909,645 | 3/1990 | Sudo et al. | 346/76 PH X |
| 4,916,486 | 4/1990 | Nakatani | 355/202 |
| 5,038,170 | 8/1991 | Serita | 355/215 X |
| 5,060,076 | 10/1991 | Curley | 346/136 X |
| 5,062,722 | 11/1991 | Shiozaki et al. | 346/76 PH X |
| 5,083,157 | 1/1992 | Smith | 355/200 |

FOREIGN PATENT DOCUMENTS

| | | | |
|---|---|---|---|
| 2494000 | 5/1982 | France . | |
| 60-39663 | 1/1985 | Japan . | |
| 0258575 | 12/1985 | Japan | 355/202 |
| 61-53665 | 3/1986 | Japan . | |

*Primary Examiner*—A. T. Grimley
*Assistant Examiner*—Robert Beatty
*Attorney, Agent, or Firm*—Beveridge, DeGrandi, Weilacher & Young

[57] ABSTRACT

An image forming apparatus includes a main part for image formation, a printing unit, a supporter, a pressing member and a punching unit. The main part for image formation includes an image processor, and a case for containing the image processor which has a door. The printing unit prints onto a sheet processed by the image processor. The printing unit includes a thermal head and a cleaning device. The supporter supports the printing unit such that the printing unit is able to rotate between a printing position, at which the printing unit is contained in the main part, and a replacing position, at which the printing unit is located near the door. The printer unit is formed such that the cleaning device cleans the thermal head when the printer unit is moved to the replacing position. The pressing member is provided on the door in order to move the printing unit into the printing position by pressing the supporter in cooperation with the door's closing. To protect the printing unit, the apparatus also includes a insulation chamber connected at one end to a fan, with vent holes occurring at increasing intervals further away from the fan.

24 Claims, 11 Drawing Sheets

IMAGE FORMING APPARATUS HAVING A THERMAL PRINTING DEVICE

BACKGROUND OF THE INVENTION

The present invention relates to an image forming apparatus. More specifically, it relates to an image forming apparatus having a printing device capable of printing some letters on an image-formed sheet.

Japanese Patent Laying-Open No. 53665/1986 discloses an image forming apparatus which has a printing device capable of printing date, name of company, etc. on a sheet of image-formed paper. The printing device essentially consists of an ink-ribbon cassette containing an ink ribbon, and a printing head for pressing the ink ribbon against paper for printing.

The printing quality of the printing device may deteriorate if for example dust or foreign matter becomes affixed to the printing head. Therefore, the printing head must be cleaned regularly.

The printing quality of the letters printed on a sheet by the printing device may also deteriorate, due to heat generated by the fixing unit, which performs its image-fixing process at a high temperature. Since the printing device is located close to the high-temperature fixing device the ink ribbon in the printing device is susceptible to deterioration due to the heat from the fixing unit. The ink ribbon may even melt on occasion.

In maintenance, the printing head should be cleaned, and a printing device having a decayed ink ribbon must be replaced. Since the printing unit is installed as it is within the image forming apparatus, however, it is difficult to clean the printing unit and/or replace it during maintenance.

SUMMARY OF THE INVENTION

It is an object of the present invention to provide an image forming apparatus of which maintenance is facilitated.

It is another object of the present invention to provide an image forming apparatus of which maintenance may be smoothly performed without risk of damage to its printing unit.

It is another object of the present invention to provide an image forming apparatus having a simple mechanism for supporting a printing unit, whereby maintenance is facilitated.

It is still another object of the present invention to provide an image forming apparatus in which the printing head is easily cleaned.

It is yet another object of the present invention to provide an image forming apparatus in which the effect of heat from its fixing unit upon the printing unit is negligible.

(1) An image forming apparatus according to an aspect of the present invention includes a main part for image formation, and a printing device having a printing unit, a supporter, and a pressing member. The main part for image formation includes an image processor, and a case for containing the image processor which includes a door. The printing device prints onto a sheet having been processed by the image processor. The supporter supports the printing unit such that the printing unit is able to rotate within the main part for image formation between a printing position, at which the printing unit is contained in the main part, and a replacing position, at which the printing unit is located near the door. The pressing member is provided on the door for moving the printing unit into the printing position by pressing against the supporter in cooperation with the door's closing.

According to the invention in this aspect, the printing unit is located in the printing position wherein it prints onto a sheet already processed to contain an image. In maintenance, the door is opened, whereupon the printing unit is moved into the replacing position. After the completion of maintenance, the door is closed, whereby the pressing member presses against the supporter in cooperation with the door's closing. As a result, the printing unit located at the replacing position is moved into the printing position.

The replacing position into which the printing unit is moved is near the door location, thus facilitating maintenance. Furthermore, since after maintenance the printing unit is moved into the printing position by the action of the pressing member pressing against the supporter in cooperation with the door's closing, the damage to the printing unit due to jarring by the door can occur.

(2) A mechanism according to another aspect of the present invention supports a printing unit in an image forming apparatus. It includes a holder, a supporter and a stop.

The holder holds the printing unit. The supporter supports the holder such that it is movable between a printing position, at which the printing unit is contained within the image forming apparatus, and a replacing position, at which the printing unit is disclosed. The stop retains the holder at the replacing position.

According to the present invention in this aspect, the printing unit is located at the printing position for printing onto a sheet. In maintenance, the printing unit is moved into the replacing position, at which the stop arrests the movement. Maintenance work then may be performed upon the printing unit now located in the replacing position.

Since the holder holding the printing unit is able to be moved into such a replacing position, maintenance is facilitated. Furthermore, since the wall of the case of the image forming apparatus incorporates the stop which limits the movement of the holder, its structure is simple.

(3) An image forming apparatus according to another aspect of the present invention includes an image forming part, a printing unit, a printing head, and a cleaner.

The printing unit is movable between a printing position, for printing onto a sheet having been processed by the image forming part, and a replacing position. The printing head is movable between a printing position and a drawn position in cooperation with the movement of the printing unit. The cleaner meets the printing head in such a manner as to clean the printing head during its movement.

According to the invention in this aspect, the printing unit is located in the printing position when it prints onto a sheet. The printing head is cleaned, when the printing unit is moved between the printing position and the replacing position. Moving the printing unit in turn moves the printing head, whereby the printing head meets the cleaner and is cleaned by it.

Accordingly, since the printing head is cleaned by the movement of the printing unit when, for example, the printing unit is replaced, cleaning of the printing head is facilitated.

(4) An image forming apparatus according to yet another aspect of the present invention includes an image forming part, a fixing unit, a printing device, and an insulator. The fixing unit performs a fixing process in which the image formed on a sheet by the image forming part is fixed. The printing device prints onto the sheet processed by the fixing unit. The insulator is disposed between the printing device and the fixing unit in order to insulate the printing device from the heat of the fixing unit.

According to the invention in this aspect, since the insulator insulates the printing unit from the heat of the fixing unit, the printing device is much less subject to the deteriorating effects of the heat from the fixing unit.

These and other objects and advantages of the present invention will be more fully apparent from the following detailed description.

DETAILED DESCRIPTION OF THE PREFERRED EMBODIMENT

Figure 1:
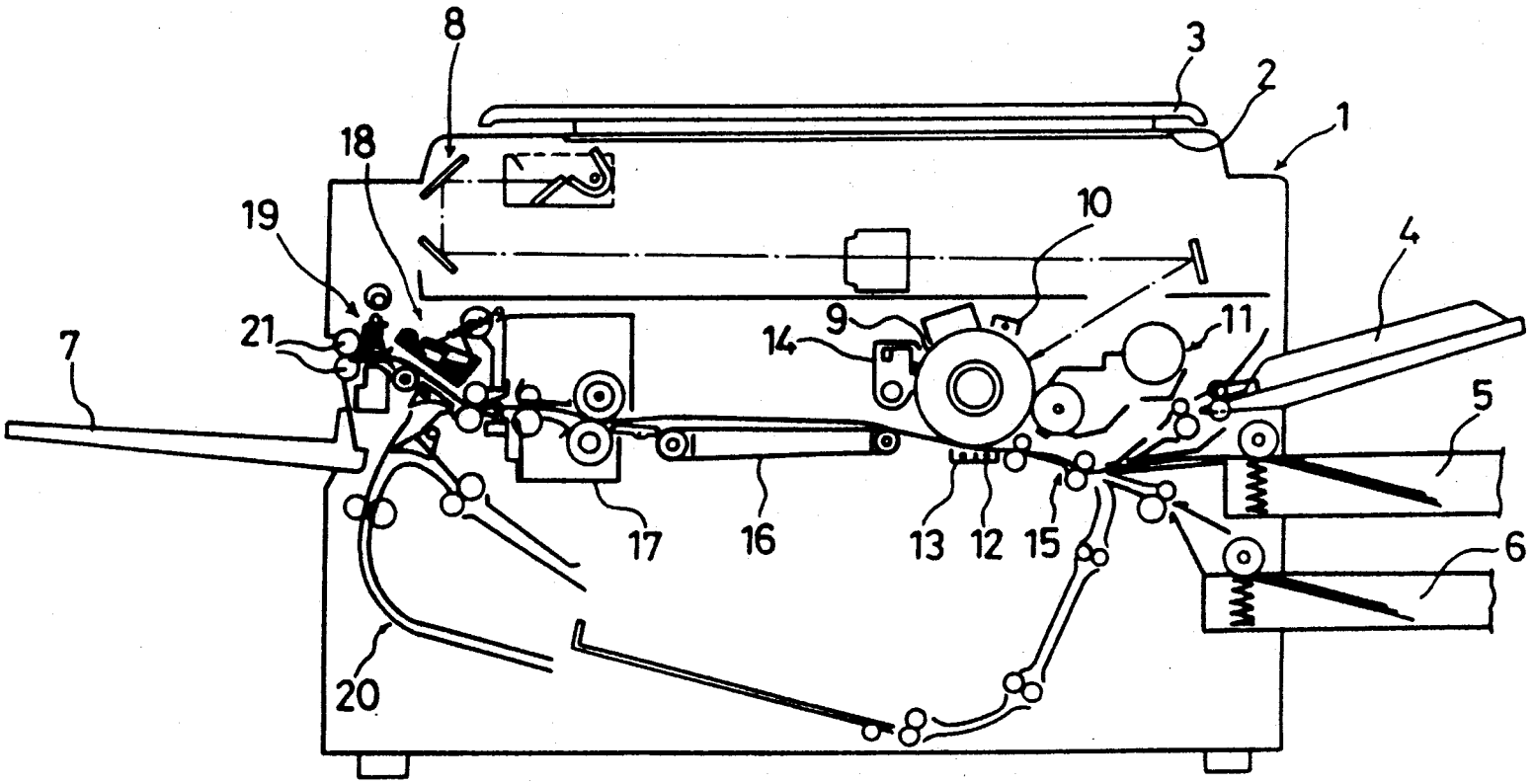
FIG. 1 is a schematic sectional view showing a copying machine according to the present invention.

Referring to FIG. 1, the body 1 of a copying machine according to the present invention has a contact glass 2 in the upper surface, and an original holder 3, which can be opened, disposed on the contact glass 2. On the right side in the figure of the body 1, a bypass tray 4 and a pair of paper cassette cases 5 and 6 are detachably attached. On the left side of the body 1, a copy tray 7 is attached wherein processed paper is received.

In the body 1, an optical exposure system 8 for obtaining information from the original image is located in the upper portion. The exposure system 8 consists of a light source, mirrors and lenses. Disposed in the central part of a lower portion of the body 1 is a photoconductive drum 9 on which an electrostatic image is formed. Surrounding the photoconductive drum 9, there are a main charger 10 for charging the photoconductive drum 9 with a predetermined level of electric charge, a developing unit 11 for developing an electrostatic image, a transfer unit 12 for transferring a toner image to paper, a detach unit 13 for detaching paper from the photoconductive drum 9, and a cleaning unit 14 for removing toner from the photoconductive drum 9, in that order.

A paper transporting path 15 extends from the bypass tray 4 and the paper cassette cases 5 and 6 to the image forming part, which consists of the photoconductive drum 9 and related elements. Disposed between the image forming part and the copy tray 7 are a paper discharging path 16, a fixing unit 17, a printing device 18 and a punching unit 19, in that order from the image forming part. A reversing device 20 which turns sheets over is provided under the fixing unit 17.

The printing device 18 and the punching unit 19 will be described more detail.

Figure 2:
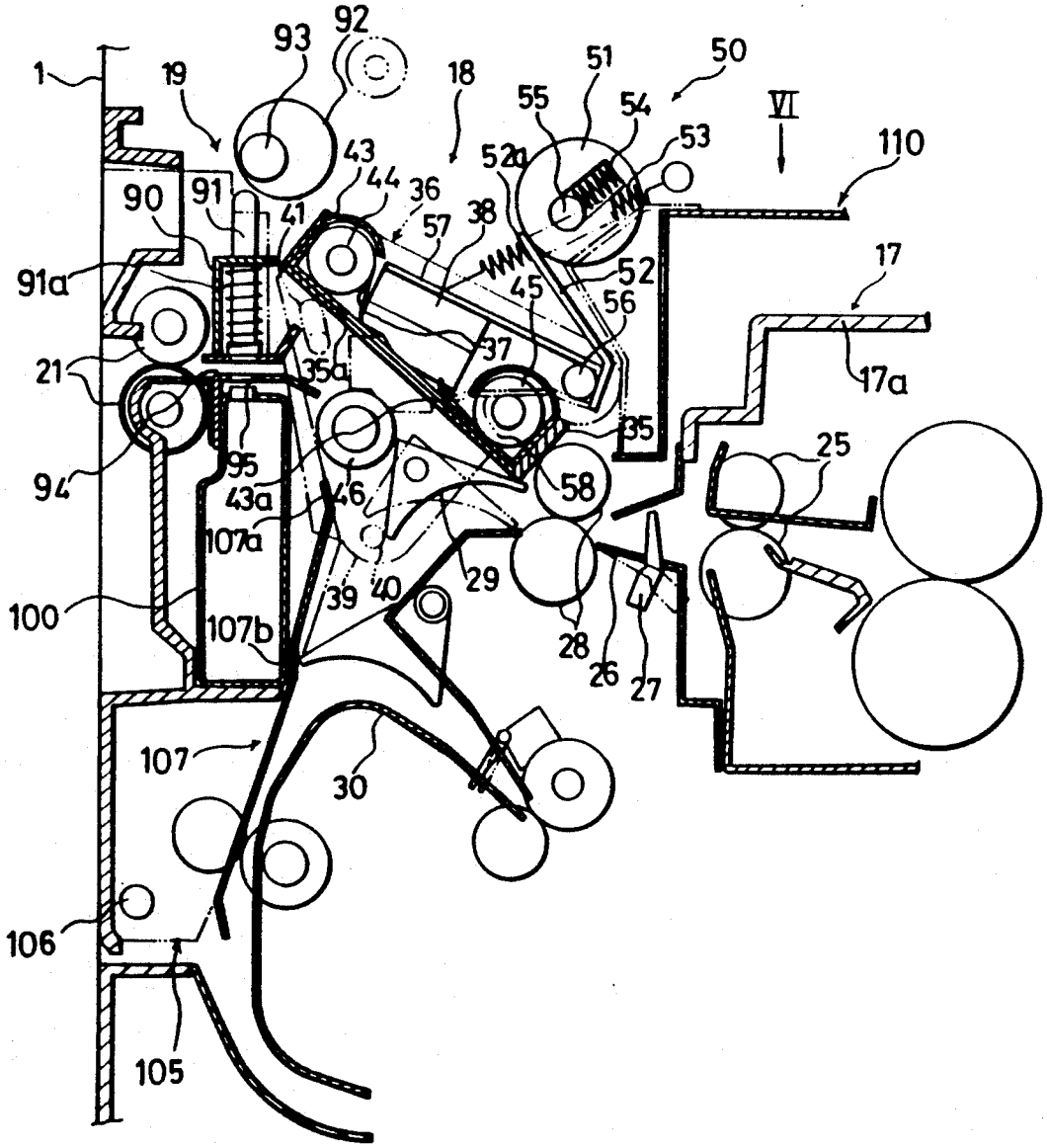
FIG. 2 is an enlarged partial view of FIG. 1.

Referring to FIG. 2, a pair of discharging rollers 25 are provided in the discharging opening of the fixing unit 17. A paper transferring path 26 extends in a part of the paper flow stream beyond the discharging rollers 25. The path 26 has a paper detecting switch 27 and a pair of transferring rollers 28. A switching claw 29 is provided in the paper transferring path 26 beyond the transferring rollers 28. The switching claw 29 is able to rotate between a discharging position, (indicated by a phantom line) for guiding a sheet toward the discharging rollers 21, and a recirculating position (indicated by a solid line) for guiding a sheet toward a recirculating path 30.

The printing device 18 and the punching unit 19 are disposed in the paper path between the transferring rollers 28 and the discharging rollers 21.

Figure 3:
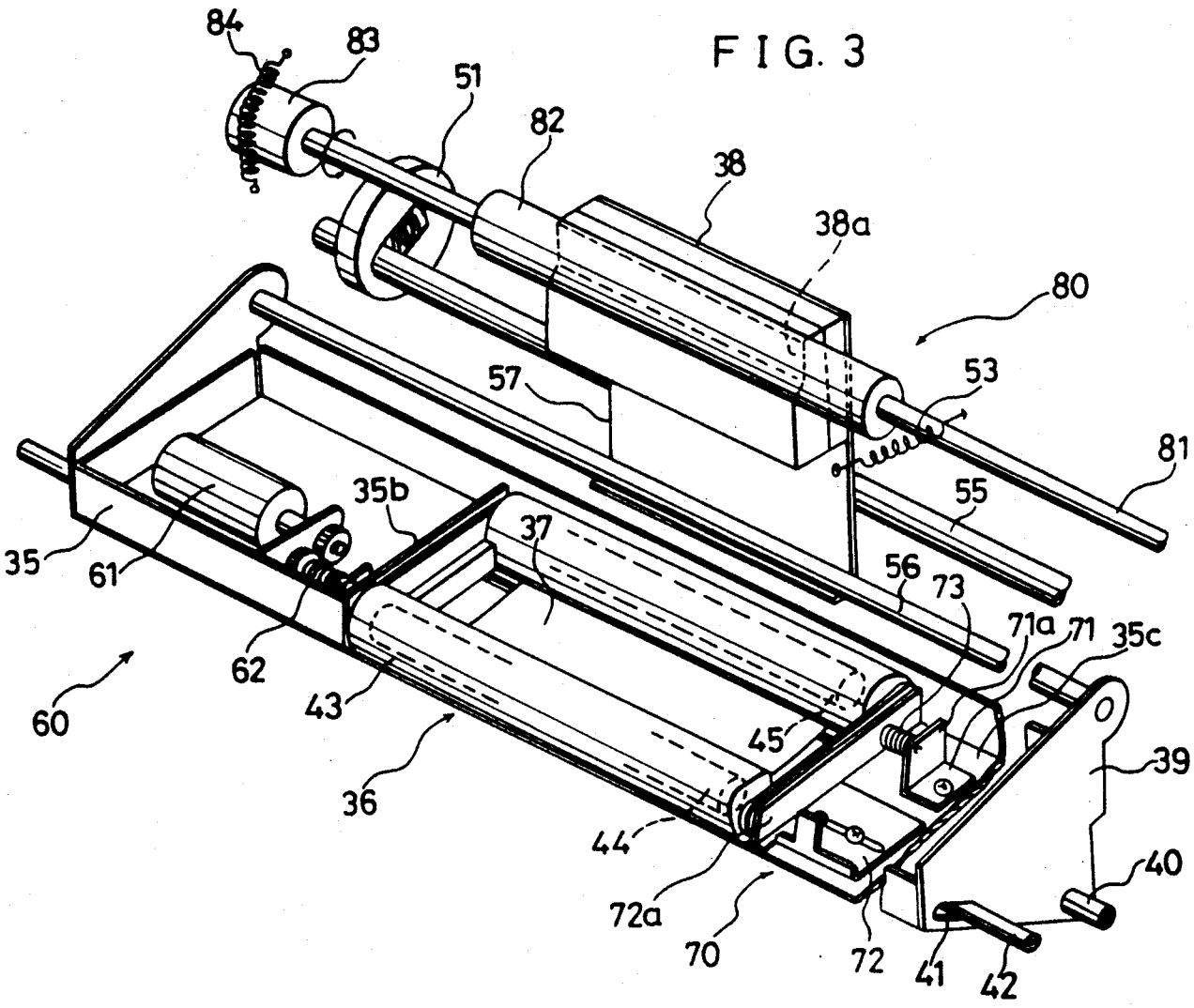
FIG. 3 is a perspective view showing a cleaner.

The printing device 18 as shown in FIG. 3 prints predetermined additional information onto a sheet which has been processed by the fixing unit 17. The printing device 18 chiefly consists of a casing or holder 35, an ink-ribbon cassette or printing unit 36 which is detachably held by the casing 35, and a thermal head 38 which is capable of pressing against ink ribbon 37 in the ink-ribbon cassette 36.

Figure 8:
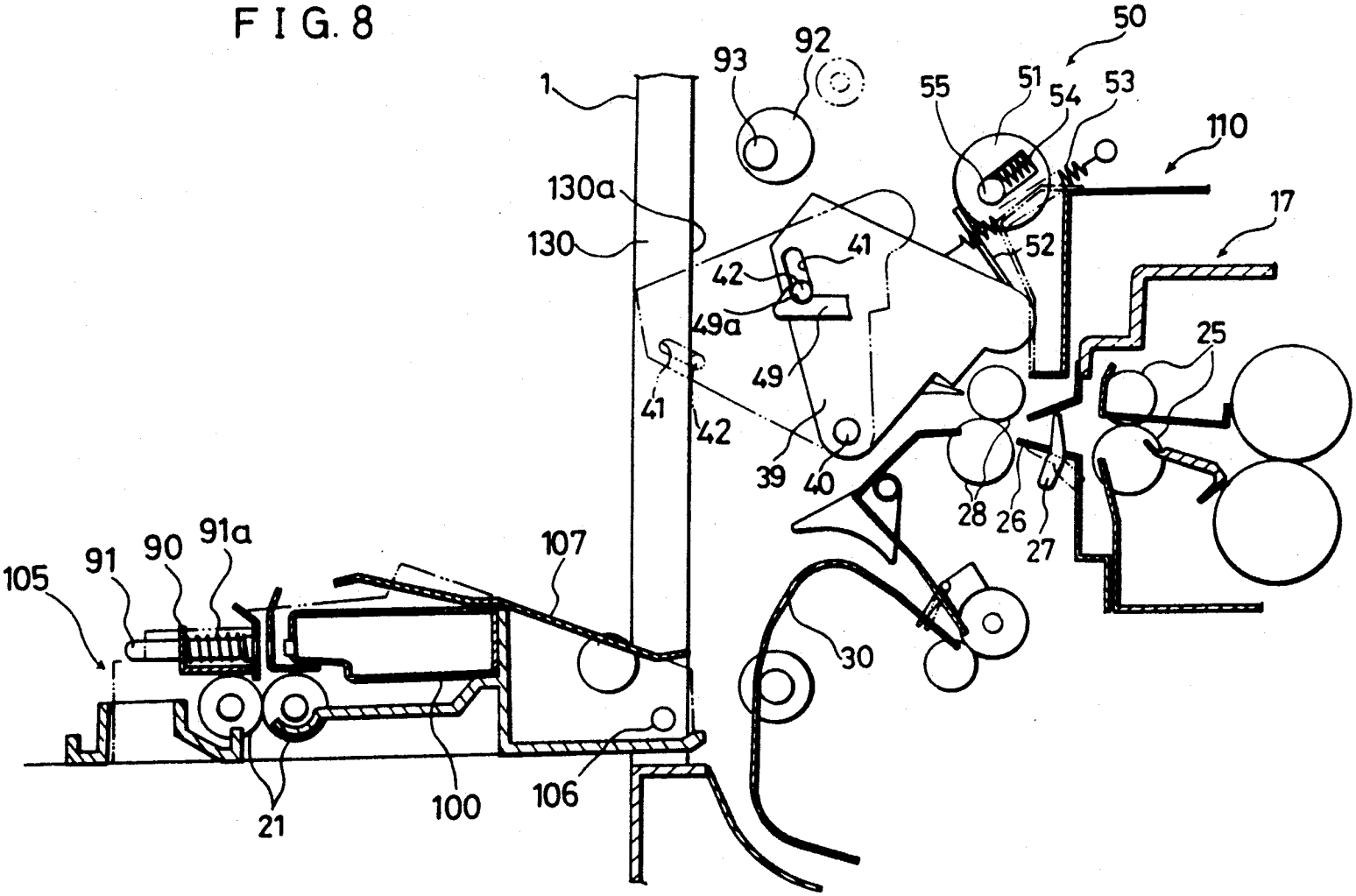
FIG. 8 is a view in correspondence with FIG. 2 showing a punching unit drawn down.

A pair of triangular flanges 39 extending downwards are provided at both ends of the casing 35 in the crosswise direction, or the direction perpendicular to the plane of FIG. 2. Pins 40 are fitted into the bottom portions of the flanges 39, so that the flanges 39 are capable of rotating on the pins 40. In corresponding upper portions of each flange 39 are opposing slots 41. Referring to FIG. 8, fitted into the slots 41 is a supporting rod 42 extending in the direction perpendicular to the plane of FIG. 8. Catches 49 rotatably supported by the body 1 are forced upward by an energy storing mechanism (not shown). The catches 49 each have a catching portion 49*a* which receives the supporting rod 42 in the printing position, indicated by solid lines in the figure.

Referring back to FIG. 2 and FIG. 3, the ink-ribbon cassette 36 consists of the ink ribbon 37, receiving and supplying reels 44 and 45 on which the ink ribbon 37 is wound, and a body 43 which contains the ink ribbon 37 and the reels 44 and 45. The body 43 and the casing 35 have openings 43*a* and 35*a* in the central portion of the bottom walls. The thermal head 38 presses the ink ribbon 37 through the openings 43*a* and 35*a* onto a platen 46 located below.

A mechanism 50 for driving the thermal head 38 consists chiefly of a cam 51, a leaf spring 52 which is in contact with the cam 51, and a return spring 53 to draw the thermal head 38 up. Inside the cam 51 is a slot. In the slot, there are an eccentric rod 55 and a coil spring 54 which is compressed against it. The eccentric rod 55 is connected to a rotating mechanism (not shown).

The casing 35 of the printing device 18 is rotatably supported by a support rod 56 which extends in the direction perpendicular to the plane of FIG. 2. The support rod 56 is directly connected to the bottom portion of a plate 57 which contains thermal head 38. The support rod 56 is also directly connected to the bottom portion of the leaf spring 52. Consequently, when the cam 51 rotates and presses down the leaf spring 52, the thermal head 38 is moved downward. The support rod 56 is furthermore directly connected to the base portion of a lower leaf spring 58. When the head portion of the lower leaf spring 58 is in contact with the bottom wall of the casing 35, the return spring 53 maintains upward tension on the thermal head 38 in order to counteract the resiliency of the lower leaf spring 58.

A driving mechanism 60 for driving the ink-ribbon cassette 36 is provided in the casing 35 as shown in FIG. 3. The driving mechanism 60 consists chiefly of a motor 61 and a torque limiter 62 which transmits the torque of the motor 61 to the receiving reel 44 of the ink-ribbon cassette 36. There is a standing wall **35*b* between the torque limiter 62 and the ink-ribbon cassette 36. When the ink-ribbon cassette 36 is installed in the casing 35, one end of the ink-ribbon cassette 36 abuts the standing wall 35*b*, and the receiving reel 44 engages the torque limiter 62 through a hole (not shown) formed in the standing wall 35*b***.

Along the opposite end of the ink-ribbon cassette 36 in the casing 35, there is a holding mechanism 70 for fixedly accommodating the ink-ribbon cassette 36 within the casing 35. The holding mechanism 70 consists of a stationary member 71 which is affixed to the bottom portion **35*c* of the casing 35, a sliding member 72 which is slidable along the bottom portion 35*c* in the lateral direction, or the direction in parallel with the axes of the reels 44 and 45, and a spring 73 which is compressed between standing walls 71*a* and 72*a* of the fixed member 71 and the sliding member 72, respectively. The spring 73 presses the sliding member 72 against the ink-ribbon cassette 36, so that the ink-ribbon cassette 36 is gripped by the pair of standing walls 72*a* and 35*b* of the sliding member 72 and the casing 35, respectively. A plurality of projections (not shown) are formed on the surface of the standing wall 72*a* facing to the ink-ribbon cassette 36. Likewise a plurality of dimples are formed on the surface of the ink-ribbon cassette 36 which comes into contact with the standing wall 72*a* in correspondence with the projections. Consequently, when the ink-ribbon cassette 36 is installed in the casing 35, the projections of the sliding member 72 are engaged with the dimples of the ink-ribbon cassette 36. As a result, the ink-ribbon cassette 36 locates into the proper position in the casing 35** and is held tightly.

As illustration in FIG. 3, a cleaning device 80 is provided above the casing 35.

The cleaning device 80 has a rotatable rod 81 which is parallel to the support rod 56. The rod 81 has a cleaning roller 82 thereon which is adjacent to the head surface **38*a* of the thermal head 38 in its drawn position. The outer surface of the cleaning roller 82 is made of a head-cleaning material such as felt. A one-way clutch 83 is connected to one end of the rod 81. The one-way clutch 83 allows the rod 81 to rotate only in the direction indicated by the arrow, whereas it locks the rod 81 in the opposite direction. Elastic members 84 such as coil springs, one of which is shown in the figure, are provided at both ends of the rod 81. The elastic members 84 force the cleaning roller 82 to press against the head surface 38*a* of the thermal head 38** in its drawn position.

With reference again to FIG. 2, the punching unit 19 has a pair of punches 91 which are vertically movable within a guide member 90. The punches 91 are spaced apart from each other at a predetermined distance in the direction perpendicular to the plane of FIG. 2. Each punch 91 is sustained upwards by the elastic energy of a coil spring **91*a* disposed in the guide member 90. Provided above each punch 91 is a cam 92 for driving the punch 91 vertically. The cams 92 have a common axis 93 which is connected to a driving mechanism (not shown). A guide plate 94 for sheet guidance is located below the punches 91. The guide plate 94 has corresponding die holes 95 which admit the punches 91**.

Figure 4:
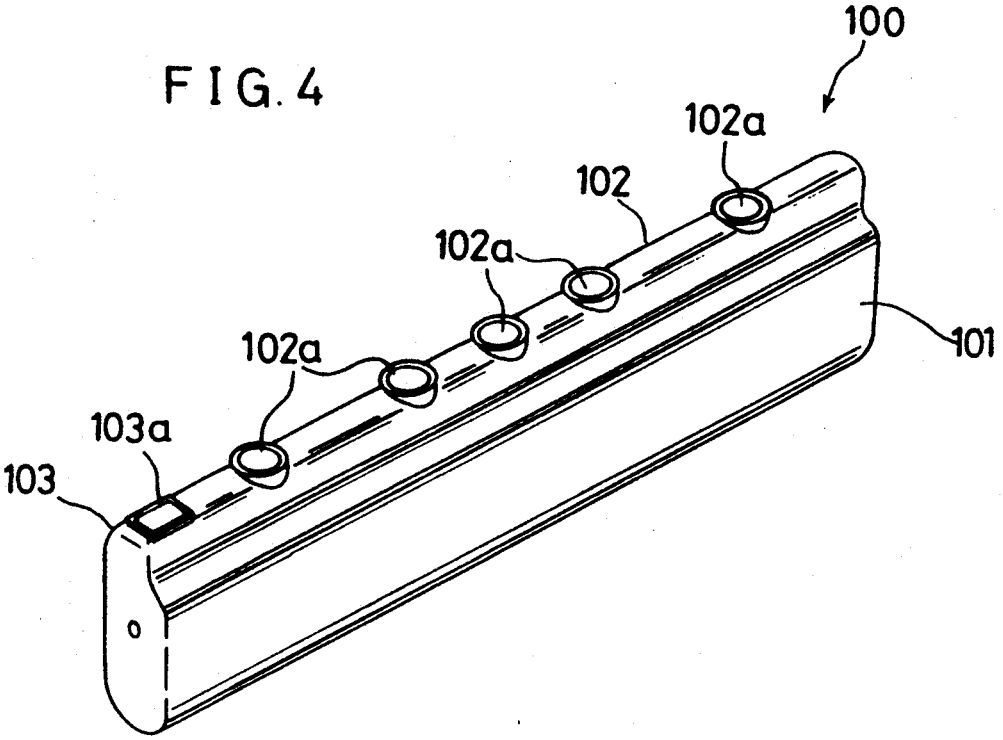
FIG. 4 is an isometric view showing a trash bottle.

A trash bottle 100 is located below the die holes 95 for receiving punched-out chips of paper. Referring to FIG. 4, the trash bottle 100 has a containing portion 101 to contain the chips of paper, and a portion 102 having a plurality (five in the figure) of openings **102*a* through which the chips of paper drop into the containing portion 101. The position of the openings 102*a* corresponds to the position of the punches 91 and die holes 95. The bottle 100 further has a discharging portion 103 at one end of the containing portion 101, which includes an opening 103*a* for discharging the punched-out chips from the containing portion 101**.

Referring back to FIG. 2, the punching unit 19, the trash bottle 100 and the discharging rollers 21 constitute a unit 105 which is rotatable about a rod 106 provided in the bottom portion of the unit 105. The unit 105 is detachably attached to the body 1 by a lock mechanism consisting of pins (not shown) fixed to the body 1 and a lock lever **105*a* (FIGS. 9 and 10) provided in the unit 105. A plate 107 is affixed to the bottom portion of the unit 105 at its lower end, and a pressing element 107*a* in the free end of the plate 107 is in contact with the flanges 39 of the casing 35. The pressing element 107*a* thereby elastically presses against the casing 35 such that the casing 35 is forced toward the right in FIG. 2. A middle portion 107*b* of the plate 107 is configured along the adjoining surface of the bottom end of the trash bottle 100** so as to retain it.

Figure 5:
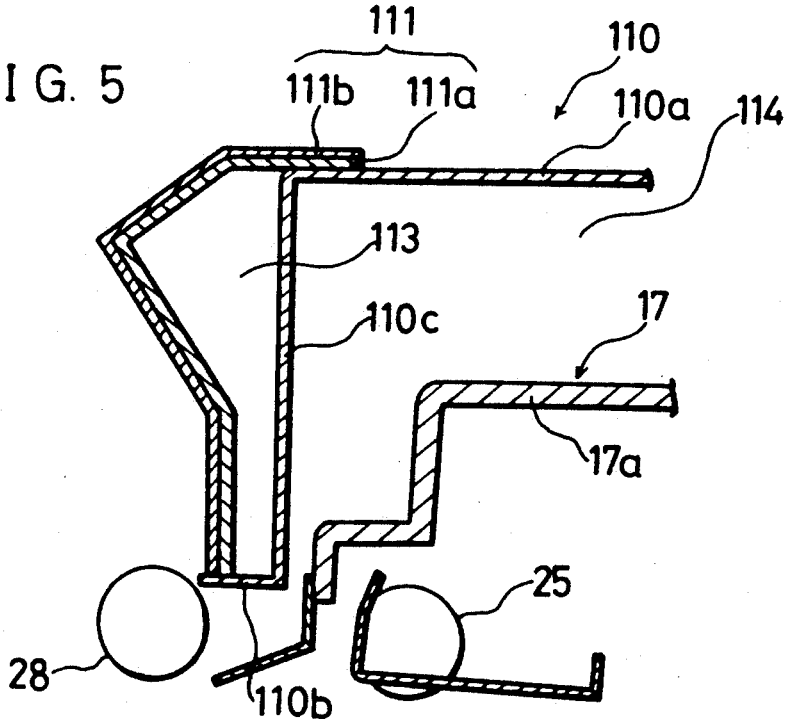
FIG. 5 is an enlarged, partial view of FIG. 2.

Above the fixing unit 17 is a partition 110 extending over an upper cover **17*a* of the fixing unit 17. Near the printing device 18, a separating plate 111 shown in FIG. 5 is provided on the partition 110. The separating plate 111 consists of a plate body 111*a*, and an insulation sheet 111*b* affixed on the outer surface of the plate body 111*a*. The upper portion of the separating plate 111 is fixed to the top wall 110*a* of the partition 110, and the bottom portion of the separating plate 111 is fixed to a turned portion 110*b* of the partition 110. The separating plate 111 and a side wall 110*c* of the partition 110 define an insulation chamber 113**.

Figure 6:
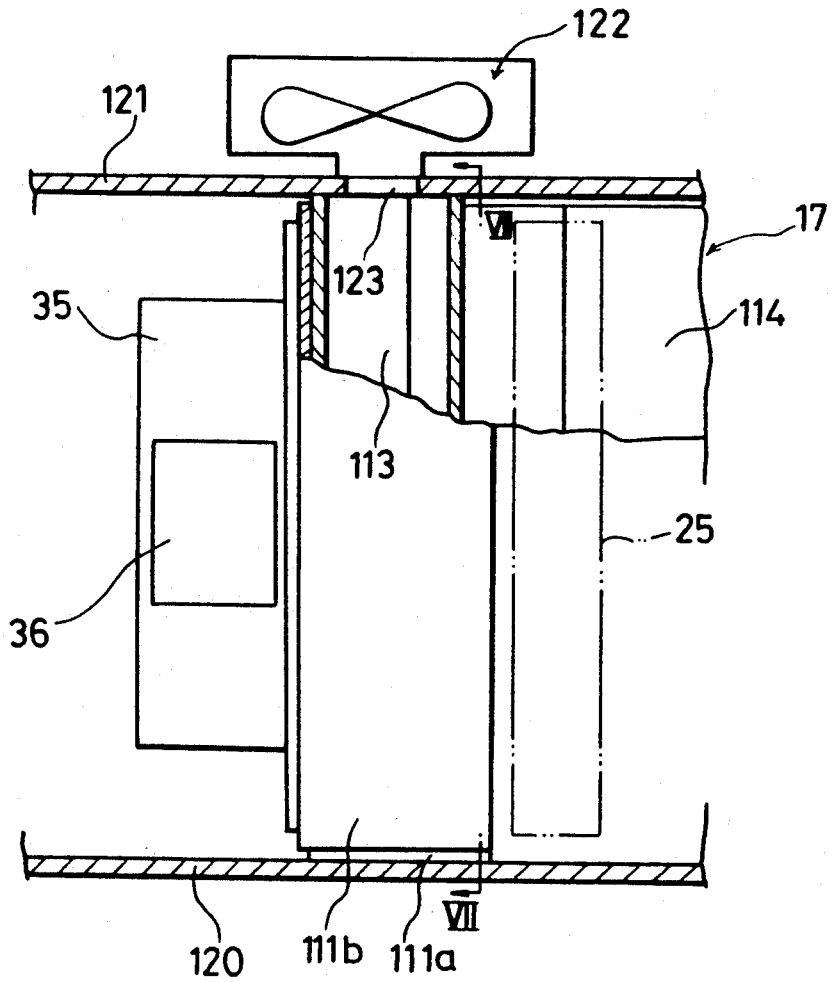
FIG. 6 is a view from the direction indicated by arrow VI of FIG. 2.
Figure 7:
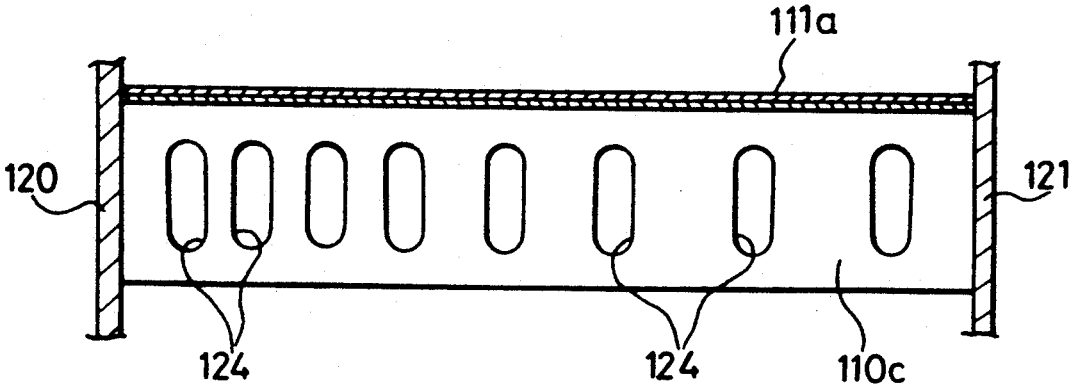
FIG. 7 is a sectional view taken along the line VII—VII of FIG. 6.

Both ends of the separating plate 111 in the direction perpendicular to the plane of FIG. 5 are fixed to the inner surface of front and rear frames 120 and 121 as shown in FIG. 6. On the outer surface of the rear frame 121 is a fan 122. The fan 122 is provided principally to vent the air from the insulation chamber 113. The rear frame 121 has an opening 123 through which the fan 122 and the insulation chamber 113 communicate with respect to the air flow. Referring to FIG. 7, the side wall **110*c* of the partition 110 has a plurality of holes 124 through which the space 114 (FIG. 6) above the fixing unit 17, and the insulation chamber 113 (FIG. 6), communicate with each other. The holes 124 are disposed at decreasing intervals in the direction toward the front frame 120**.

The operation of the embodiment will be hereinafter described.

A sheet processed by the image forming part and then by the fixing unit 17 is discharged from the fixing unit 17 by the discharging rollers 25. The sheet is then transferred by the transferring rollers 28 to the printing device 18.

The fixing unit 17 generates high temperatures during an image forming process, causing the space 114 above the fixing unit 17 to become heated, and raising the temperature of the partition 110. Since the separating plate 111 is provided between the partition 110 and the printing device 18, however, the insulation chamber 113 effects thermal insulation by which heat conducted from the fixing unit 17 to the printing device 18 is negligible. Furthermore, since the separating plate 111 includes the insulation sheet 111*b*, the insulation from heat is more efficacious.

The fan 122 vents the air from the insulation chamber 113 through the opening 123 shown in FIG. 6, whereby heat conduction from the fixing unit 17 to the printing device 18 is more effectively prevented. Since the side wall 110*c* between the insulation chamber 113 and the space 114 has a plurality of holes 124, the air in the space 114 is also vented by the fan 122. Since the intervals of the openings 124 are wider in the direction toward the fan 122, the air passing through each hole 124 is equalized in volume in order to cool the space 114 uniformly, although the fan 122 more readily draws out the air in the space 114 nearer the fan 122.

Operation during maintenance will hereinafter be described.

In maintenance, the unit 105 is turned outwardly down about the rod 106, when, for example, the ink ribbon 37 of the ink-ribbon cassette 36 is replaced or the punched-out chips in the trash bottle 100 are discharged. As a consequence of the rotation of the unit 105, the unit 105 comes out from the body 1 as shown in FIG. 8.

Figure 9:
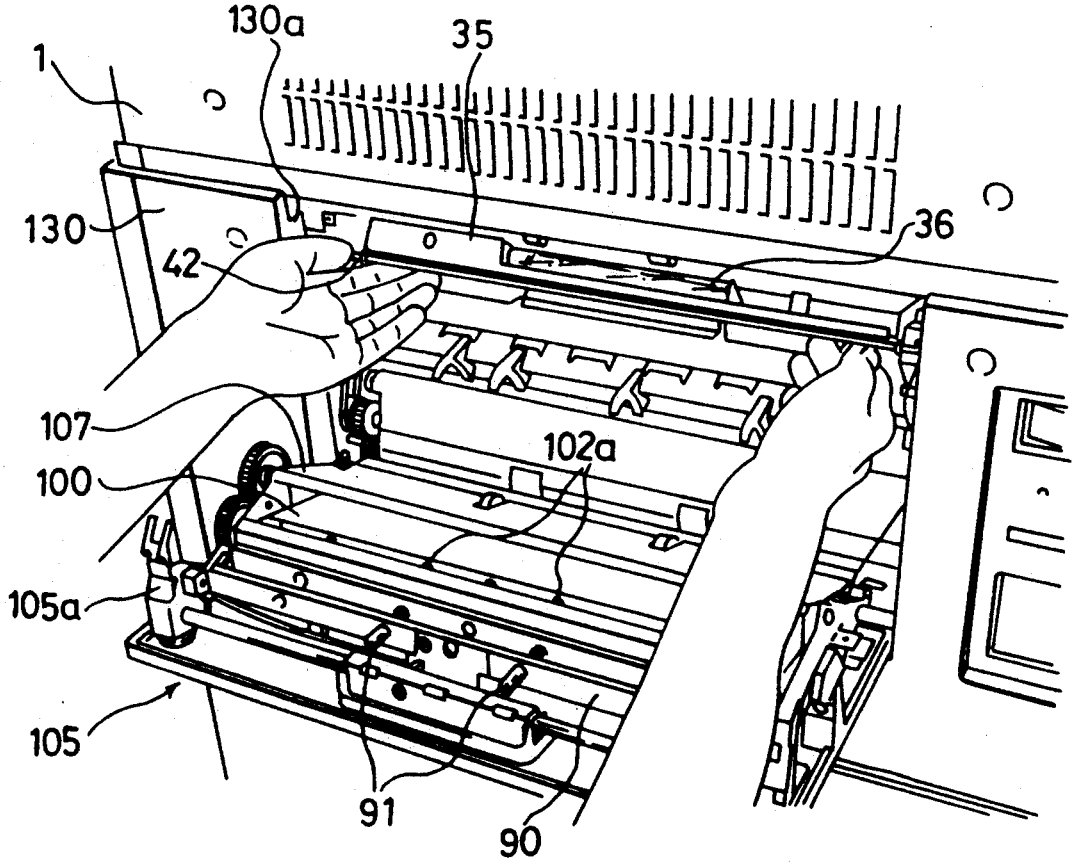
FIG. 9 is a perspective view showing the copying machine in maintenance.
Figure 10:
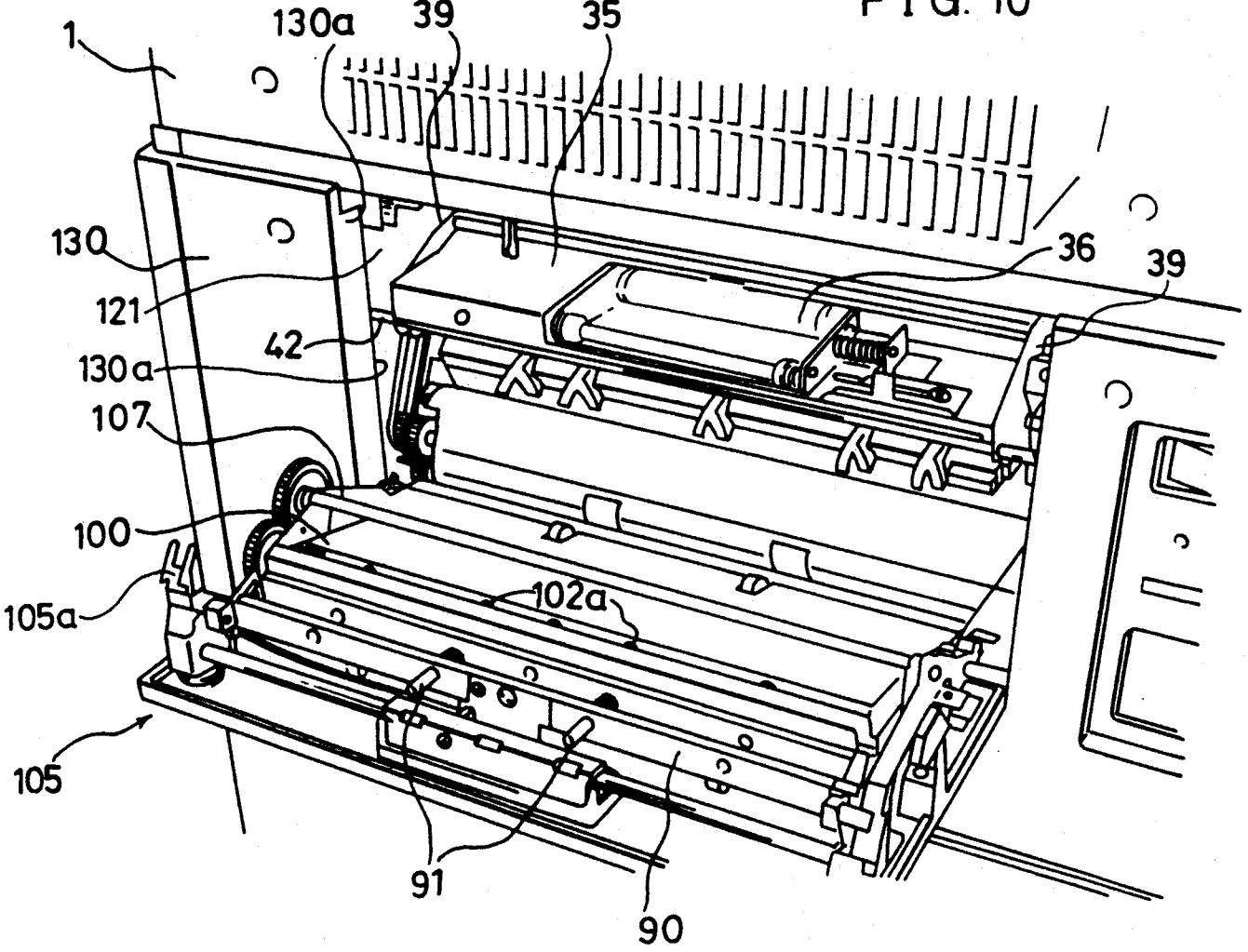
FIG. 10 is another perspective view showing the copying machine in maintenance.
Figure 11:
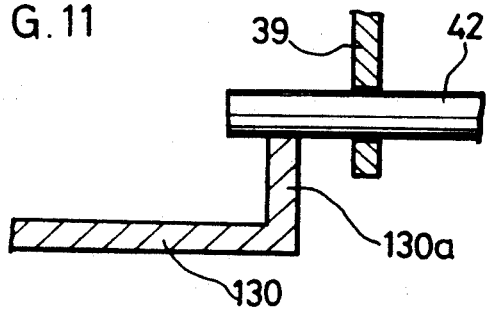
FIG. 11 is a sectional view showing a stop.

In order to replace the ink-ribbon cassette 36, as shown in FIG. 9, an operator pulls up the supporting rod 42 in the slot 41 (shown in FIG. 8) so that the supporting rod 42 is disengaged from the hooks 49. Then, the printing device 18 is turned about the pins 40 by pulling outwards on the supporting rod 42, so that the printing device 18 is located at the unit-replacing position indicated by double-dotted broken lines in FIG. 8. When the ends (only the left end is shown in FIG. 11) of the supporting rod 42 meet the edge surfaces of turned portions 130*a* of a side cover 130 of the body 1, the rotation of the printing device 18 stops, and the ink-ribbon cassette 36 is disclosed, as shown in FIG. 10, to allow its replacement. Consequently, a maintenance operation which includes cassette replacement can be easily performed, since the printing apparatus 18 is disclosed in the opening of the side cover 130.

Figure 13:
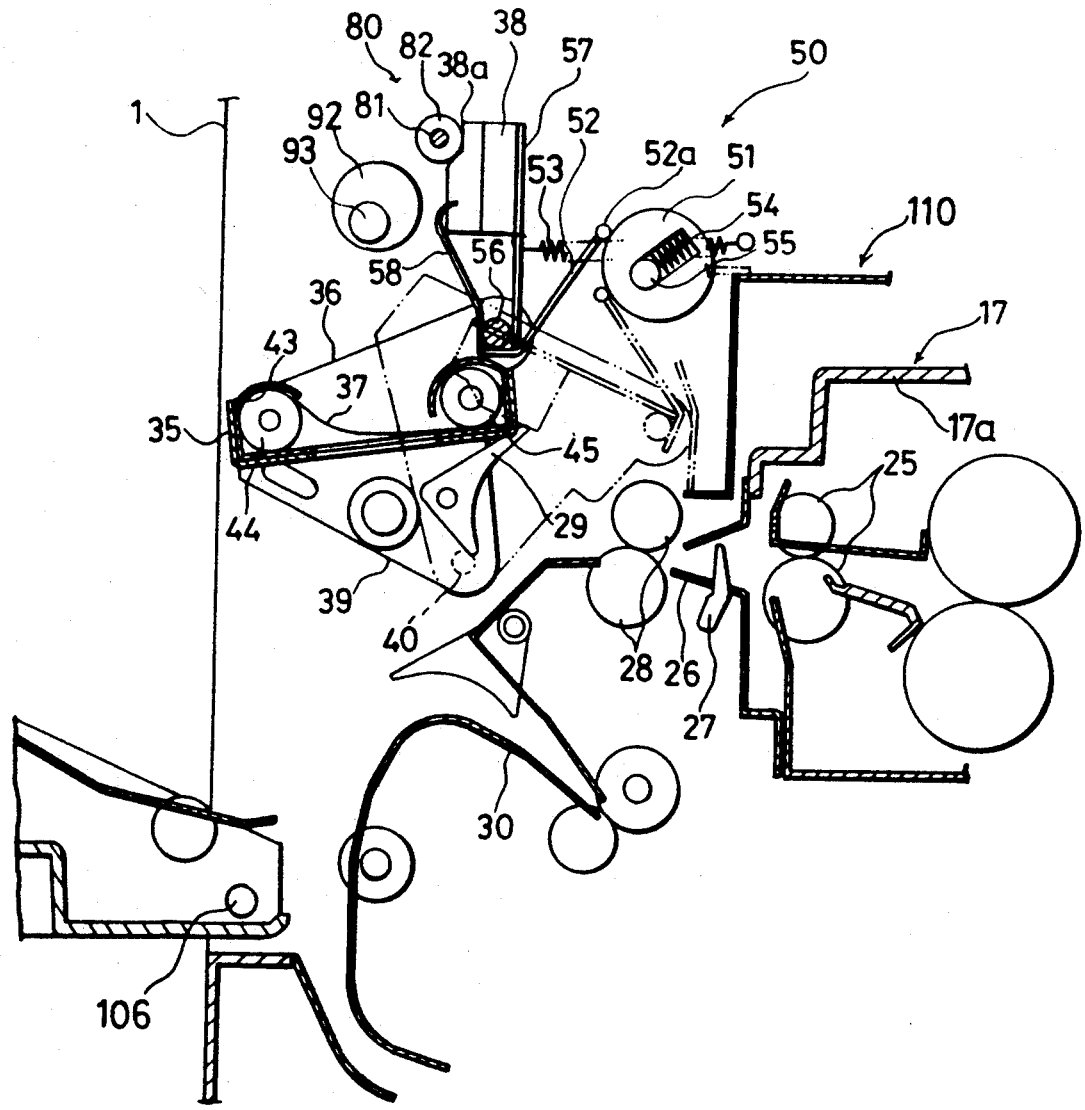
FIG. 13 is a view in correspondence with FIG. 2 showing a cleaning apparatus cleaning a thermal head.

When the ink-ribbon cassette 36 is moved into the replacing position, the casing 35 and the supporting rod 56 rotate about the pins 40, and a roller 52*a* at the end of the leaf spring 52 moves upward along the surface of the cam 51. Consequently, the support rod 56 rotates clockwise in FIG. 13. As a result, when the ink-ribbon cassette 36 is located in the replacing position, the thermal head 38 is located in the drawn position, as indicated by solid lines in FIG. 13.

When the thermal head 38 is located in the drawn position, the head surface 38*a* of the thermal head 38 comes into contact with the cleaning roller 82 of the cleaning device 80. By means of the elastic members 84, the cleaning roller 82 is elastically held against the head surface 38*a*. As the cleaning roller 82 meets the thermal head 38, the thermal head 38 moves upward along the cleaning roller 82, and the cleaning roller 82 rotates freely in the direction indicated by the arrow in FIG. 3 due to the one-way clutch 84.

Figure 12:
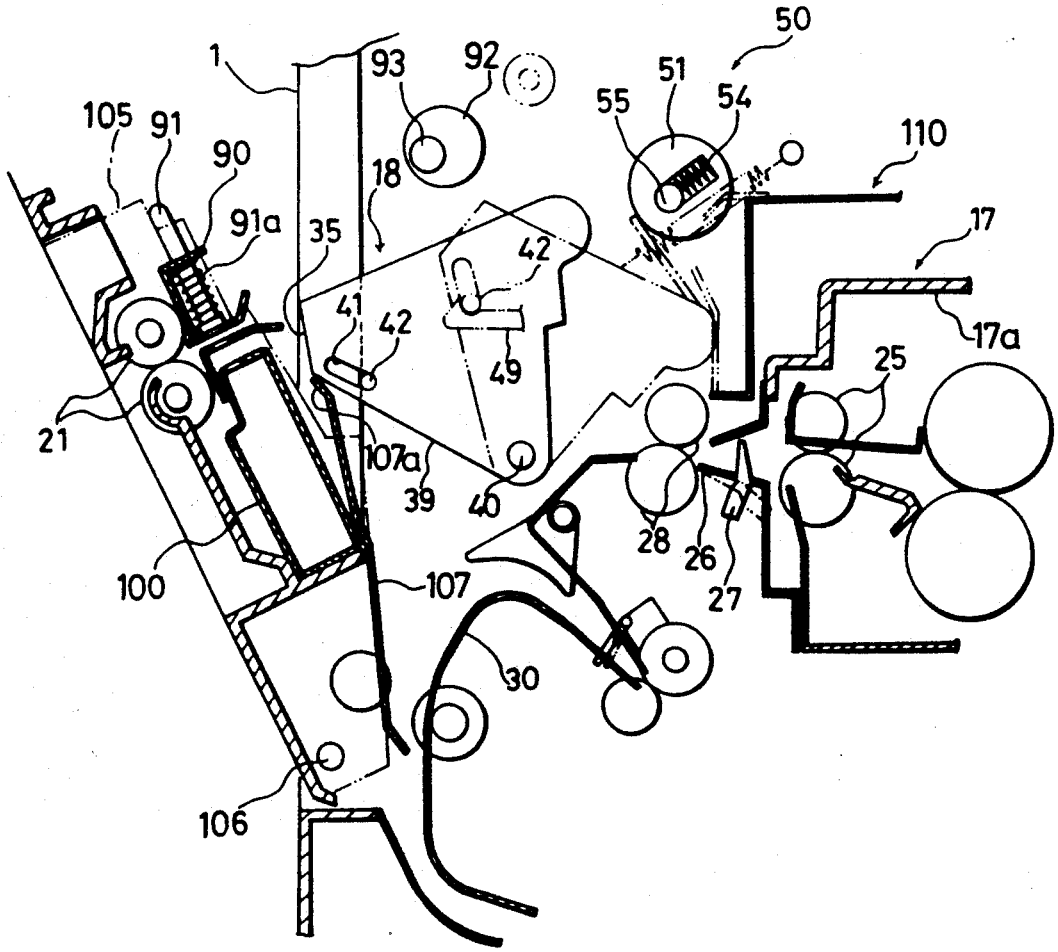
FIG. 12 is a view in correspondence with FIG. 2 showing the punching unit on its way into the body of the copying machine.

After replacement of the cassette 36, the unit 105 is pivoted back into the body 1 from the position shown in FIG. 10. The plate 107 moves in conjunction with the pivoting unit 105, and the pressing element 107*a* of the plate 107 comes into contact with the flanges 39 of the casing 35. As the unit 105 pivots further, the pressing element 107*a* presses against the flanges 39, raising the casing 35. The casing 35 is thereby pivoted about the pins 40, placing the printing device 18 into the printing position indicated by double-dotted broken lines in FIG. 12. The supporting rod 42 in the slots 41 automatically engages the hooks 49.

Thus, the unit 105, in pivoting back into the body 1, drives the printing device 18 into the printing position by means of the plate 107 after replacement of the unit is completed. As a result, the deteriorating effects on the printing device 18 of jarring by the unit 105 cannot occur even if rotation of the unit 105 is performed carelessly by an operator. Furthermore, the maintenance operation is simplified, because the printing device 18 is moved back into the printing position by the rotation of the unit 105 toward the body 1, and the thermal head is moved back into its proper position by the movement of the leaf spring 52 down along the cam 51.

In respect to the movement of the thermal head 38, the support rod 56 rotates with the casing 35 about the pins 40 such that the thermal head 38 is moved downward. Meanwhile, since the cleaning roller 82 is locked against the downward movement of the thermal head 38, and is pressed against the head surface 38*a* of the thermal head 38, the cleaning roller 82 scrubs the head surface 38*a* of the thermal head 38, thereby cleaning it. Thus, in moving the ink-ribbon cassette 36 from the replacing position into the printing position cleaning of the thermal head 38 is achieved.

As the casing 35 is further pivoted, the thermal head 38 leaves the cleaning roller 82. Then, when the ink-ribbon cassette 36 is placed at the printing position, the thermal head 38 is located in its printing position wherein it makes contact with the ink ribbon 37.

MODIFICATION

A copying machine according to the above embodiment employs the supporting rod 42 and the hooks 49 for holding the printing device 18 in the printing position. However, the supporting rod 42 and the hooks 49 might be omitted, if the pressing element 107*a* is of enough strength to retain the printing device 18 in the printing position.

In this case, if the center of gravity of the printing device 18 is located between the axis of rotation, i.e., the pins 40, and the unit 105, the printing device would be automatically disclosed when the unit 105 is opened.

Figure 14:
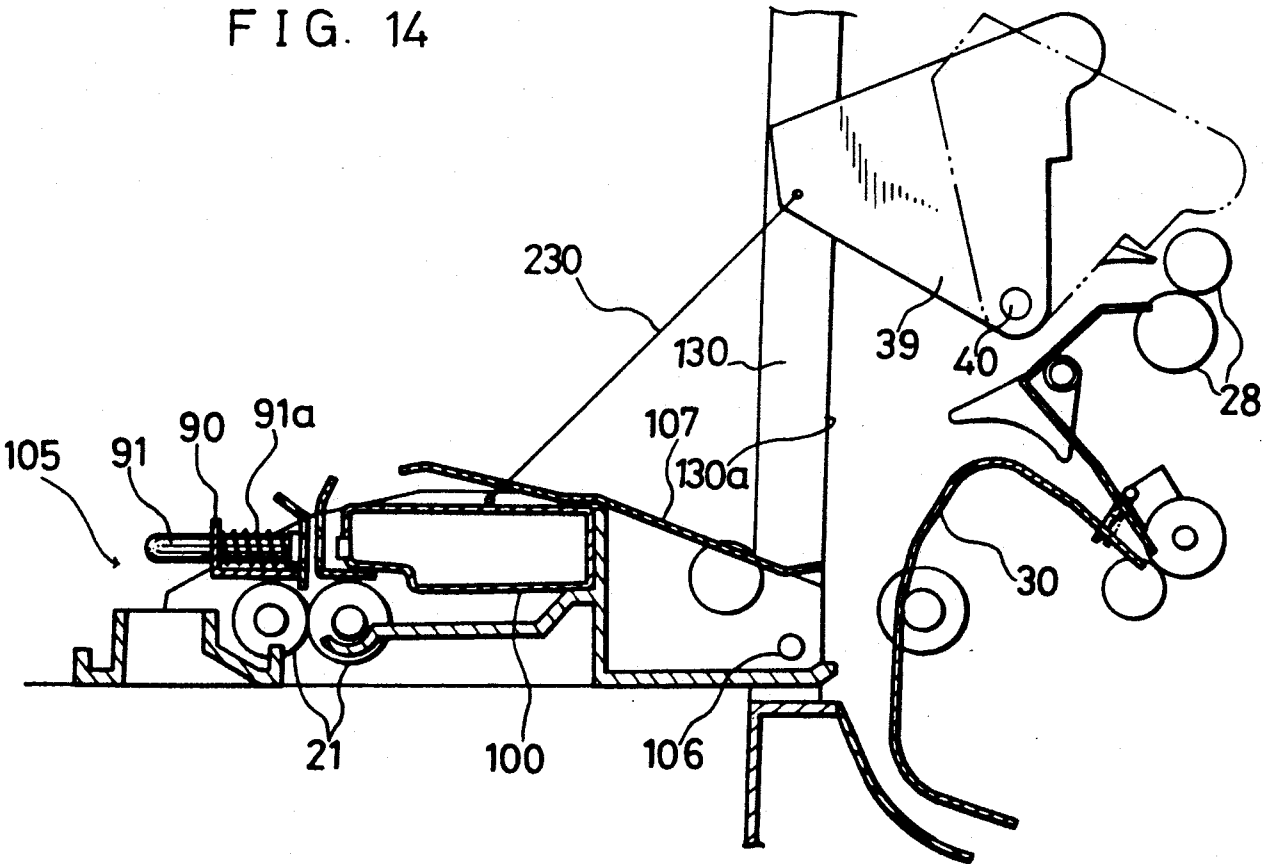
FIG. 14 is a view in correspondence with FIG. 2 showing another embodiment according to the present invention.

As illustrated in FIG. 14, a wire 230 of a predetermined length may be provided connecting the unit 105 and the flanges 39 of the printing device 18. In this case, the printing device 18 is brought out into the replacing position when the unit 105 is opened, because the unit 105 draws out the printing device 18 by means of the wire.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What is claimed is:

1. An image forming apparatus comprising:

an image forming unit which includes an image forming part and an enclosing wall having a door and surrounding said imaging forming part;

a printing device for printing onto a sheet processed by said image forming part, said printing device having a printing unit which includes an ink ribbon, supplying and receiving reels on which said ink ribbon is wound, and a body for containing said ink ribbon and said reels, a thermal head movable between a printing position and a drawn position;

a thermal head driver for moving said thermal head in cooperation with the movement of said printing unit; and a platen against which said thermal head presses said ink ribbon;

connecting means for rotatably connecting said printing unit with said image forming unit, whereby said printing unit is movable between a printing position, at which said printing unit is located within said image forming unit, and a replacing position when said door is opened, at which said printing unit is located in proximity to said door, said connecting means including a pair of flanges and a support member for rotatably supporting said flanges; and a pusher provided on said door which pushes said printing unit into said printing position by pressing against said connecting means in cooperation with closing of said door;

wherein said printing unit is detachably connected to said connecting means.

2. An apparatus according to claim 1, wherein said door has its bottom portion rotatably supported by said enclosing wall; and said pusher consists of a plate member of which the bottom portion is fixed to the bottom portion of said door, and the top portion elastically presses at least one of said flanges inward of said image forming unit.

3. An apparatus according to claim 1 further comprising a limiter for limiting the movement of said connecting means, wherein said image forming unit further includes a stop against which said limiter rests in said replacing position.

4. An apparatus according to claim 3 further comprising a fastener for disengageably fastening said connecting means to said image forming unit when said printing unit is located in said printing position.

5. An apparatus according to claim 1 further comprising a link for linking said door and said connecting means in order to bring said printing unit into said replacing position in cooperation with the opening of said door.

6. An apparatus according to claim 1, wherein said thermal head is rotatably supported by said connecting means, and leaves said platen in cooperation with the rotation of said connecting means.

7. An apparatus according to claim 6, wherein said thermal head driver includes a rotor rod, a cam provided on said rotor rod, first energy storing means abutting on the cam surface of said cam to force said thermal head toward said printing position, and second energy storing means to force said thermal head toward said drawn position.

8. An image forming apparatus comprising:

an image forming unit which includes an image forming part and an enclosing wall having a door and surrounding said imaging forming part;

a printing device for printing onto a sheet processed by said image forming part, said printing device having a printing unit which includes an ink ribbon, supplying and receiving reels on which said ink ribbon is wound, and a body for containing said ink ribbon and said reels;

connecting means for rotatably connecting said printing unit with said image forming unit, whereby said printing unit is movable between a printing position, at which said printing unit is located within said image forming unit, and a replacing position when said door is opened, at which said printing unit is located in proximity to said door, said connecting means including a pair of flanges and a support member for rotatably supporting said flanges, each of said flanges having a slot opposite the other;

a pusher provided on said door which pushes said printing unit into said printing position by pressing against said connecting means in cooperation with closing of said door; and a fastener for disengageably fastening said connecting means to said image forming unit when said printing unit is located in said printing position, said fastener including a rod inserted into said slots, and catches provided in said image forming unit disconnectably connected to said rod.

9. An image forming apparatus comprising:

an image forming unit which includes an image forming part and an enclosing wall having a door and surrounding said imaging forming part;

a printing device for printing onto a sheet processed by said image forming part, said printing device having a printing unit which includes an ink ribbon, supplying and receiving reels on which said ink ribbon is wound, and a body for containing said ink ribbon and said reels;

connecting means for rotatably connecting said printing unit with said image forming unit, whereby said printing unit is movable between a printing position, at which said printing unit is located within said image forming unit, and a replacing position when said door is opened, at which said printing unit is located in proximity to said door; and a pusher provided on said door which pushes said printing unit into said printing position by pressing against said connecting means in cooperation with closing of said door;

a punching unit disposed in said door in the direction beyond said printing unit with respect to paper flow, wherein said printing unit is detachably connected to said connecting means.

10. An apparatus according to claim 9, wherein said punching unit includes:

a plurality of punches which are movable in the direction of the sheet thickness and disposed at predetermined intervals along the direction of sheet width;

a guide plate disposed opposite to said punches and having a plurality of die holes into which said punches are insertable; and a trash bottle located below said guide plate, for collecting punched-out chips created by said punches and die holes.

11. An image forming apparatus comprising:

an image forming unit including an image forming part and an enclosing wall which surrounds said image forming part;

a printing device for printing onto a sheet, and having a printing unit which includes an ink ribbon, supplying and receiving reels on which said ink ribbon is wound, and a body for containing said ink ribbon and said reels;

connecting means for connecting said printing unit rotatably with said image forming unit, whereby said printing unit is movable between a printing position, in which said printing unit is located in said image forming unit, and a replacing position, in which said printing unit is exteriorly exposed, said connecting means including a pair of flanges spaced apart from each other, and a support member for rotatably supporting said flanges;

a limiter formed of a rod for limiting movement of said connecting means by resting against said enclosing wall in said replacing position, said flanges have opposing holes into which said rod is inserted; and a catch provided in said image forming unit for releasably catching said rod, whereby said catch fixes said connecting means into said image forming unit when said printing unit is located in said printing position; wherein said printing unit is detachably connected to said connecting means.

12. An image forming apparatus comprising:

an image forming unit including an image forming part and an enclosing wall which surrounds said image forming part;

a printing device for printing onto a sheet, and having a printing unit which includes an ink ribbon, supplying and receiving reels on which said ink ribbon is wound, and a body for containing said ink ribbon and said reels, a thermal head movable between a printing position and a drawn position;

a thermal head driver for moving said thermal head in cooperation with the movement of said printing unit; and a platen against which said thermal head presses said ink ribbon;

connecting means for connecting said printing unit rotatably with said image forming unit, whereby said printing unit is movable between a printing position, in which said printing unit is located in said image forming unit, and a replacing position, in which said printing unit is exteriorly exposed, said connecting means including a pair of flanges spaced apart from each other, and a support member for rotatably supporting said flanges; and a limiter for limiting movement of said connecting means by resting against said enclosing wall in said replacing position; wherein said printing unit is detachably connected to said connecting means.

13. An apparatus according to claim 12, wherein said thermal head is rotatably supported by said connecting means such that it is capable of moving away from said platen in cooperation with the rotation of said connector.

14. An apparatus according to claim 13, wherein said thermal head driver includes:

a rotor rod;

a cam provided on said rotor rod;

first energy storing means abutting on the cam surface of said cam to force said thermal head toward said printing position; and second energy storing means to force said thermal head toward said drawn position.

15. An apparatus according to claim 14, wherein said first energy storing means includes:

a plate having an end at which said thermal head is provided;

a supported rod on which the other end of said plate is connected and which is rotatably supported by said connecting means; and a leaf spring having one end in contact with the cam surface of said cam and the other end fixed to said supporting rod.

16. An image forming apparatus comprising:

an image forming part;

a printing unit which is movable between a printing position, at which a sheet processed by said image forming part undergoes a printing operation and a replacing position;

a printing head movable between a printing position and a drawn position;

a printing head driver for moving said printing head between said printing position and said drawn position in cooperation with the movement of said printing unit; and a cleaning device for cleaning said printing head, said cleaning device including means for coming into contact with said printing head during moving of said printing head to clean said head.

17. An apparatus according to claim 16, wherein said cleaning device includes a cleaning member, and energy storing means for pressing said cleaning roller onto a head surface of said thermal head.

18. An apparatus according to claim 17, wherein said cleaning member includes a rotating rod extending in parallel with said supporting rod in said image forming unit, and a cleaning roller fitted on said rotating rod adjacent to said head surface of said thermal head located at said drawn position.

19. An apparatus according to claim 18, wherein said cleaning device further includes a one-way clutch provided at an end of said rotating rod.

20. An apparatus according to claim 16, wherein said thermal head driver includes:

a rotor rod;

a cam provided on said rotor rod;

first energy storing means abutting on the cam surface of said cam to force said thermal head toward said printing position; and second energy storing means to force said thermal head toward said drawn position.

21. An apparatus according to claim 20, wherein said first energy storing means includes:

a plate having an end at which said thermal head is provided;

a supported rod on which the other end of said plate is connected and which is rotatably supported by said connecting means; and a leaf spring having one end in contact with the cam surface of said cam and the other end fixed to said supporting rod.

22. An apparatus according to claim 16 further comprising a fastener for disengageably fastening said connecting means to said image forming unit when said printing unit is located in said printing position.

23. An image forming apparatus comprising:

an image forming part;

a fixing unit for fixing an image formed by said image forming part onto a sheet;

a printing part for printing onto said sheet fixed by said fixing unit;

an insulator for thermally insulating said printing part from said fixing unit, said insulator being disposed between said printing part and said fixing unit, and including a partition extending from its side near said printing part over the upper portion of said fixing unit, and an insulating plate disposed between said partition and said printing part such that it forms an insulating chamber with said partition; and a rear frame having an opening, a front frame disposed apart from said rear frame, and a fan attached to the outer surface of said rear frame, each end of said partition being fixed to the adjoining inner surface of said frames, said insulation chamber and said fan communicating through said opening, a side wall of said partition near said insulation chamber having a plurality of holes at intervals which increase in the direction toward said rear frame.

24. An apparatus according to claim 23, wherein said insulating plate includes a plate body, and an insulation sheet affixed onto said plate body.

* * * * *